United States Patent [19]

Stenzel

[11] Patent Number: 4,629,112

[45] Date of Patent: Dec. 16, 1986

[54] RECEPTACLE WITH FLANGE CLOSURE

[75] Inventor: Peter Stenzel, Herscheid, Fed. Rep. of Germany

[73] Assignee: Alcan Ohler GmbH, Plettenberg/Ohle, Fed. Rep. of Germany

[21] Appl. No.: 709,423

[22] Filed: Mar. 7, 1985

[30] Foreign Application Priority Data

Mar. 8, 1984 [DE] Fed. Rep. of Germany ..... 3408487

[51] Int. Cl.[4] ..... B65D 43/00

[52] U.S. Cl. ..... 229/43; 206/525; 206/633; 229/3.5 MF

[58] Field of Search ..... 206/633, 525, 461, 601; 229/43, 3.5 MF

[56] References Cited

U.S. PATENT DOCUMENTS

| | | | |
|---|---|---|---|
| 2,112,170 | 3/1938 | Loos | 229/43 |
| 3,281,009 | 10/1966 | Collie et al. | 220/90.6 |
| 3,366,309 | 1/1968 | Scharre | 229/43 |
| 3,438,483 | 4/1969 | Miller et al. | 229/43 |
| 3,443,741 | 5/1969 | Stockdale | 229/43 |
| 3,854,649 | 12/1974 | Wagner et al. | 206/525 |
| 4,194,681 | 3/1980 | Scott et al. | 229/43 |
| 4,474,016 | 10/1984 | Winchell | 229/43 |

FOREIGN PATENT DOCUMENTS

| | | |
|---|---|---|
| 1586221 | 12/1971 | Fed. Rep. of Germany . |
| 1807305 | 12/1971 | Fed. Rep. of Germany . |
| 3018876 | 12/1981 | Fed. Rep. of Germany . |
| 3100761 | 7/1982 | Fed. Rep. of Germany . |

*Primary Examiner*—William Price
*Assistant Examiner*—Jimmy G. Foster
*Attorney, Agent, or Firm*—Finnegan, Henderson, Farabow, Garrett & Dunner

[57] ABSTRACT

A receptacle comprising a flange closure, consisting of a bottom part, in particular a meal tray (12), comprising a bottom, side walls adjacent thereto as well as an edge flange (22) which surrounds the top edge thereof and is directed outwardly, and further consisting of a cover (28) as a top part consisting of a foil material in the form of a rectangular foil blank (10), the four corners (14) thereof being folded around fold lines (16), which obliquely extend to the edges (18) of said foil blank (10), onto the top side thereof for forming pull flaps (20), and the sides thereof which, when laid on the bottom part, project parallel to said edge flange (22) being flanged downwardly around said flange on all sides and pressed together with the same, said edge flange (22) of the bottom part (12) of said receptacle comprising bevel corners (24) which extend substantially parallel to said fold lines (16).

4 Claims, 8 Drawing Figures

RECEPTACLE WITH FLANGE CLOSURE

DESCRIPTION

Figure 1:
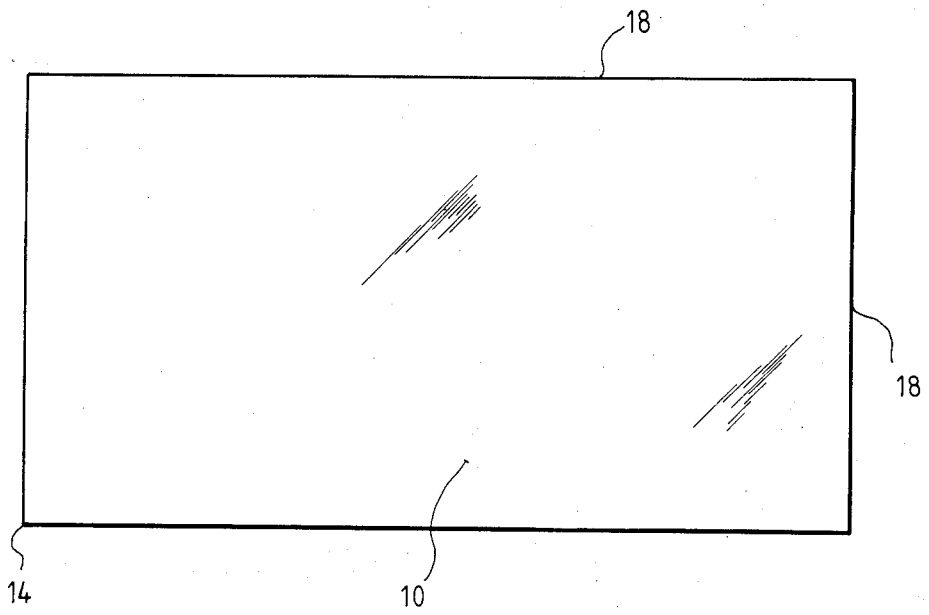

This invention relates to a receptacle comprising a flange closure, consisting of a bottom part, in particular a meal tray, comprising a bottom, side walls adjacent thereto as well as an edge flange which surrounds the top edge thereof and is directed outwardly, and further consisting of a cover as a top part consisting of a foil material in the form of a rectangular foil blank, the four corners thereof being folded around fold lines, which obliquely extend to the edges of said foil blank, onto the top side thereof for forming pull flaps, and the sides thereof which, when laid on the bottom part, project parallel to said edge flange being flanged downwardly around said flange on all sides and pressed together with the same.

Such a receptacle is described and shown in German Offenlegungsschrift No. 31 00 761. Due to the fact that the four corners of the cover are folded onto its top side and thus form pull flaps, the cover can be detached from the bottom part of the receptacle which is designed as a meal tray such that there is no risk of soiling from dripping remaining food or liquid splashes caused by akward opening. However, the known meal tray has an edge flange which is rounded off at the corners; as a result, the size of the pull flaps is limited, for, when a foil blank of the usual size is used which prior to flanging projects about the width of an edge flange over the overall dimensions of the edge flange at all four sides, relatively small pull flaps which can hardly be grasped with the fingers result by reason of the relatively small corner radius. Moreover, when the flange closure is opened in the corner portion by pulling the flap over the relatively small corner radius of the edge flange, there is a locally very disproportionate stress on the tear flap; the result is that the flaps often start to tear and tear off due to overstress.

The subject matter of German Offenlegungsschrift No. 30 18 876 is a cover consisting of a foil material for flanging on all sides with a surrounding edge flange of a meal tray which is also rounded off at the corners. First of all, the rectangular foil blank is folded with its four corners around the fold lines, which obliquely extend to the edges of the foil blank, onto its top side for forming the cover. The grip tongues formed thereby at the two opposite sides are subsequently folded onto the top side whereupon the edge portion is bent downwardly forming rounded corners. The manufacture of such a cover requires an increased number of individual steps for the formation of the grip tongues; that is why the apparatus required therefor is relatively expensive. Moreover, more operations than in the case of the receptacle according to German Offenlegungsschrift No. 31 00 761 which was already mentioned are required for opening the receptacle. Furthermore, the two grip tongues provided at the opposite sides of the receptacle require an additional amount of material which when a great number of meal trays with cover is produced in series is considerably felt.

The subject matter of German Pat. No. 15 86 221 is a method for closing filled meal trays and suchlike comprising foil covers with tear flaps being formed. However, the production method explained therein is relatively expensive and requires a considerable amount of material for forming the tear flaps. Finally, cover closures for meal trays and suchlike are known in the field wherein a tip as a pull flap is provided under the edge flange in the corner portion. This portion is not visible when there is a filled meal tray in front of the user so that he must try to seize the tip by groping under the edge flange in order to be able to open and pull off the cover. In so doing, the fingers are often soiled by the exiting, in particular liquid food because of the closure which is not completely drip-proof.

This invention is based on the task to improve the receptacle of the type outlined at the outset such that when the foil blank for the cover is as small as possible there is an opening possibility which is optimized for use without the cover being damaged or destroyed.

According to the invention, this task is solved by the feature that the edge flange of the bottom part of the receptacle comprises bevel corners which extend substantially parallel to the fold lines.

Owing to this measure, easily visible and graspable pull flaps are formed despite a minimum of material required, for, as a result of the bevel of the corners of the edge flange, there is such a great deal of additional cover length at the corners as compared to rounded corners that the pull flaps are substantially larger than in the case of the prior art. In the present case, the overall dimensions of the foil blank for the cover need not exceed the above mentioned dimensions (projection over the four sides of the width of an edge flange each).

When the cover is pulled open in an expediently diagonal manner with the help of the easily graspable pull flaps, there is no risk that the cover starts to tear because by reason of the straight bevel of the corners no increased edge tension occurs in the pull flaps.

This invention allows production with a simple apparatus which is relatively cheap for receptacles with flange closures.

Although German Auslegeschrift No. 18 07 305 describes plastic receptacles in the form of regular polygons, respectively comprising a surrounding edge flange of constant width onto which a respective cover of such a size and form and in such an arrangement with respect to the receptacle is sealed that the corner portions of the cover project over at least four flange edge corners so that four tear flaps are formed, and according to the task it is attained that when a tear flap is damaged supplementary flaps for opening the receptacle are available. For example, in the case of an octagonal receptacle the cover is arranged in a square manner—with a side length being equal to the distance of two opposite flange edge sides—and in such a manner with respect to the receptacle that its quadrangular portions project over four flange edge sides which are respectively opposite to each other.

Although these flange edge sides are obliquely arranged to the respective adjacent flange edge sides which follow the same edge line as the cover, and therefore, in retrospect, a certain similarity with the receptacle according to the invention exists, the subject matter of the application is not suggested by the above reference just by reason of the retrospective view and by reason of exactly opposite measures for the first one stands out for adaptation of the receptacle to the cover—by the edge flange being beveled parallel to the fold lines of the cover, whereas the latter teaches adaptation of the cover to the bottom part of the receptacle through corresponding size and form of the cover as well as arrangement of the same to the bottom part. However, this cannot solve the task underlying the invention. It is only the beveling of the edge flange corners according to the invention through which it is made possible to create larger tear flaps without increasing the cover foil blank—relative to the receptacle capacity—and thereby to meet the requirements of the task which contradict each other, viz., on the one hand a foil blank of the cover which is as small as possible and on the other hand an opening possibility optimized for use.

This task can only be seen in conjunction with the background of the problems arising in connection with flange closures. The teaching of the reference does not apply to its solution because when the cover is flanged its edge first disappears under the edge flange, when a pull flap located on the top side of the cover is formed measures are necessary which require considerably more efforts than a simply superposed seal cover having projecting corner portions, and there are considerable differences in the tightness of the closures and the opening behavior.

In contrast to the flange closure according to the invention, the seal closure is completely tight and requires opening forces which are considerably greater. The corner portions of the seal cover which project over the edge flange may easily be damaged on the way to the consumer or even torn off. However, if they are bent downwards as indicated in the reference, the user can only try to seize them by groping under the edge flange in contrast to the flange closure in the case of which the pull flaps are easily visible and protected. The seal closure can only be opened by holding the receptacle and simultaneously pulling at one pull flap upwardly in the diagonal direction of the receptacle whereas in the case of the flange closure according to the invention two pull flaps which are diagonally opposite are first simultaneously pulled outwardly and then downwardly and then again upwardly along the longitudinal edges of the receptacle to proceed subsequently with the two remaining corner pull flaps in the same manner. In so doing, the cover edges flanged under the edge flange become detached from the edge flange, respectively starting from the corners at whose pull laps the pull is carried out. On the whole, the flange closure according to the invention can be opened substantially more easily and at a smaller risk of soiling than the known seal closure.

Apart from its edge flange, the bottom part of the receptacle may also comprise bevels in the remaining corner portion in accordance with a development of the invention. Such bevels may for example be limited to the top edge of the side walls of the bottom part of the receptacle; however, they may also extend over its overall height down to the bottom.

On the basis of an embodiment shown in the drawing, the invention is hereinafter explained:

There are shown in

Figure 2:
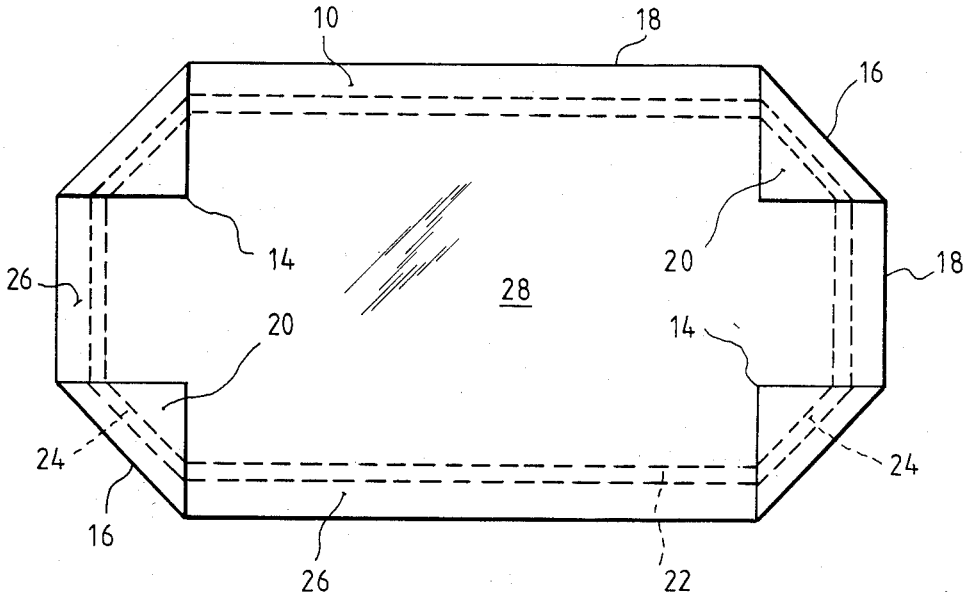
Figure 3:
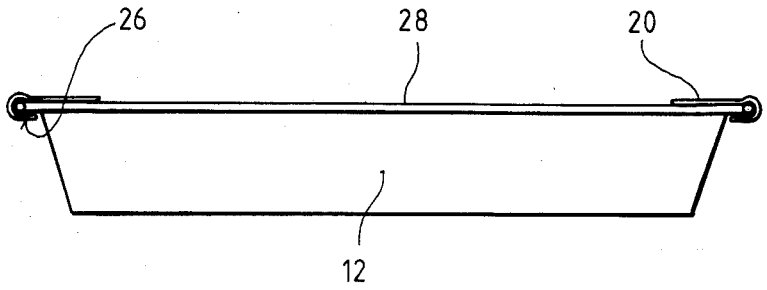
Figure 4:
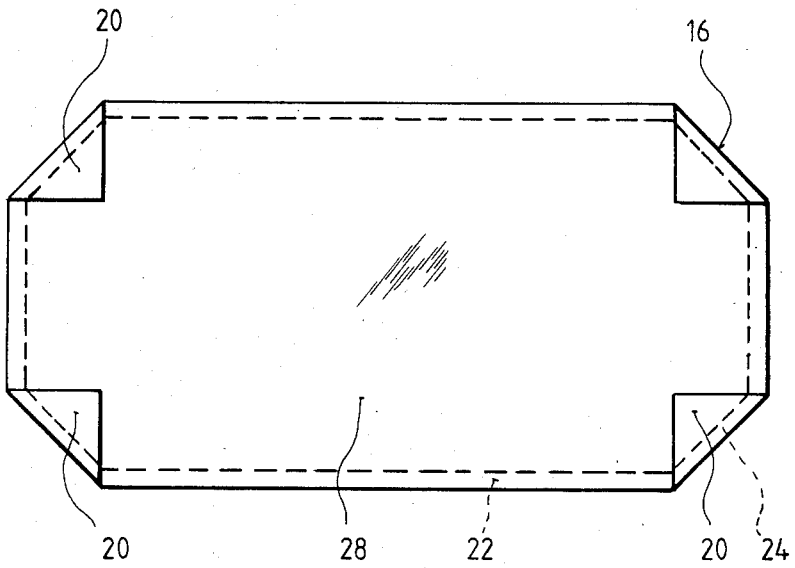
Figure 5:
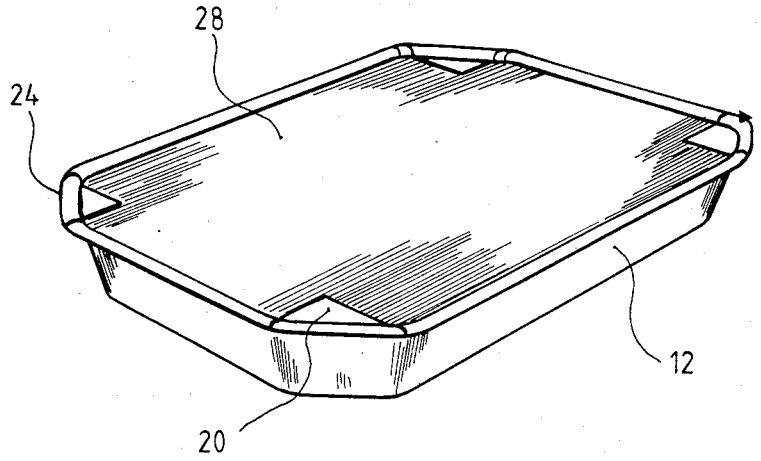
Figure 6:
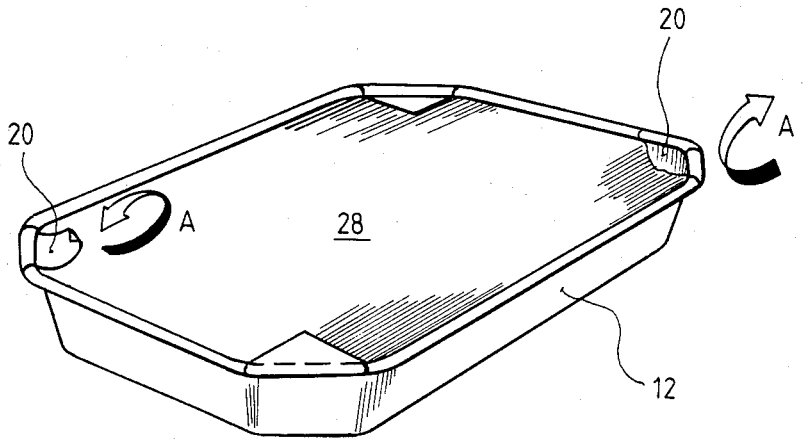
Figure 7:
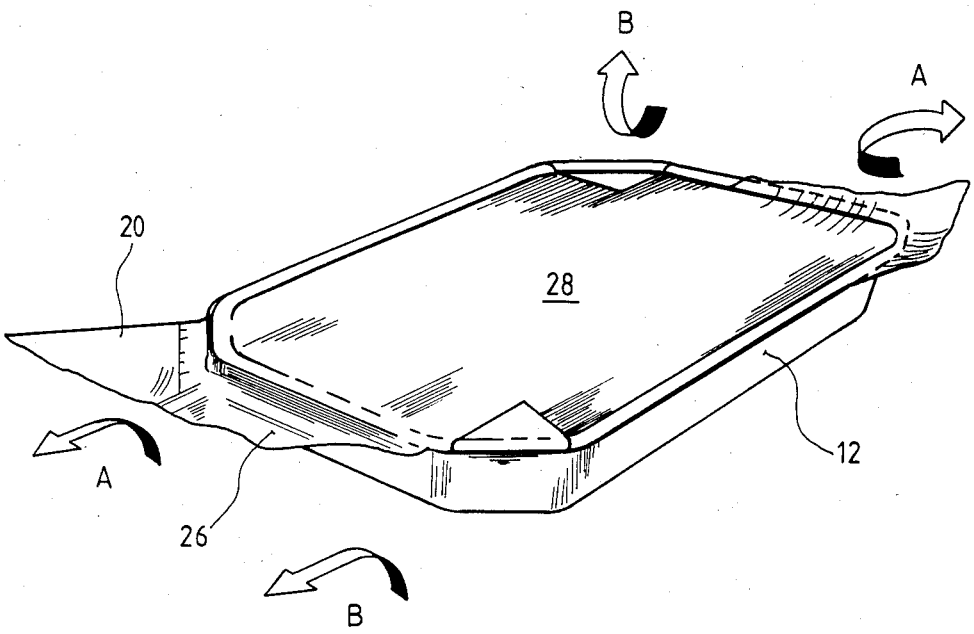
Figure 8:
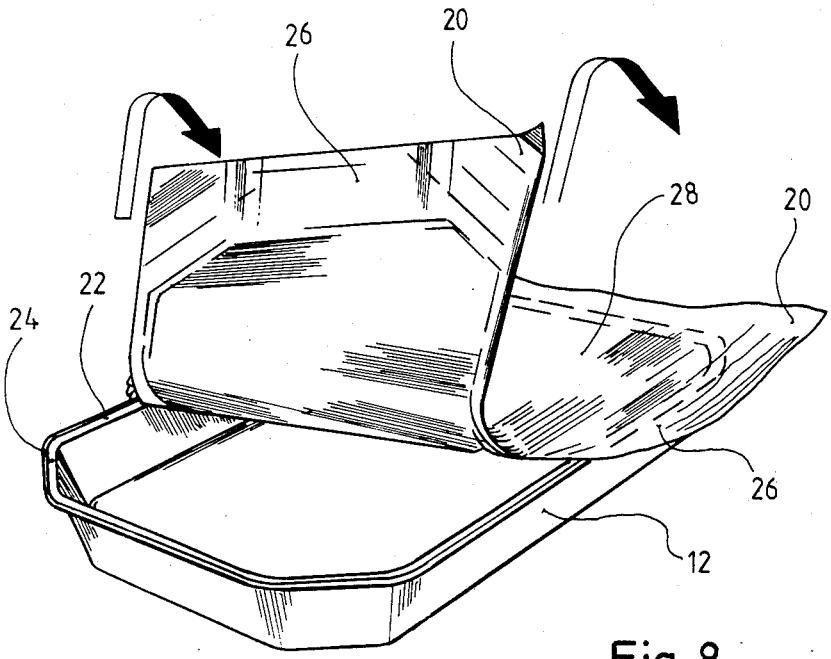

FIG. 1 a top view of a rectangular foil blank for the manufacture of the cover;

FIG. 2 the subsequent processing step for folding the four corners with the bottom part of the receptacle outlined thereunder in the form of a meal tray;

FIG. 3 a side view of the closed receptacle;

FIG. 4 a top view of the closed receptacle;

FIG. 5 a perspective representation of the closed receptacle;

FIGS. 6–8 perspective representations of three subsequent steps when the receptacle is opened.

FIG. 1 shows a rectangular foil blank 10 of aluminium which is nowhere cut in and from which the cover for closing the receptacle bottom part 12 of aluminium, for instance a meal tray, is to be manufactured.

In the operating step shown in FIG. 2 the four corners 14 are folded around the fold lines 16 onto the top side of the foil blank 10, the fold lines obliquely extending to the edges 18 of the foil blank 10, preferably forming an angle of 135° with said edges. In this way, pull flaps 20 are formed at the four corners 14.

FIGS. 2 and 4 show that the meal tray 12 has an edge flange 22 which is surrounding on the top side and whose corners 24 are beveled and extend parallel to the fold lines 16.

In a second operating step, the edge portion 26 of the cover 28 manufactured according to FIG. 2 is bent downwardly; thereby, the cover 28 for closing the meal tray 12 is ready for use.

FIGS. 3 and 4 show how the cover 28 is fastened to the meal tray 12 around the edge flange 22 of which the edge portion 26 of the cover 28 is flanged.

For the opening of the receptacle and the detachment of the cover 28, it is now sufficient to seize the respectively opposite pull flaps 20 in pairs and to detach them by pulling them diagonally outwardly away from the edge flange 22 of the meal tray 12.

In FIGS. 6 and 7, arrows A indicate the detachment of two pull flaps 20 which are diagonally opposite, and arrows B the subsequent detachment of the two other pull flaps 20. The pull flaps 20 are first pulled outwardly approximately in the receptacle plane and then downwardly until the whole edge portion 26 of the cover 28 flanged under the edge flange 22 gradually detaches. As shown in FIG. 8, the cover 28 can then be lifted upwardly without it being destroyed and without any difficulties.

During the whole opening process, the receptacle continuously remains at its place. Since the cover 28 is lifted above the meal tray 12, remaining filling substance sticking to the bottom side of the cover 28 only drops back into the meal tray 12 and thereby does not soil the dining place.

I claim:

1. A receptacle comprising a tray and a cover removably secured thereto, said tray being substantially rectangular having four corners, a bottom wall, side walls adjacent thereto and an edge flange that surrounds and projects outwardly from the top edges of the side walls, said edge flange having beveled corners having a substantially straight edge in each of the four corners of the tray and said cover comprising a rectangular blank of foil material, the edges of which are substantially parallel to and extend out over the edge flange of the tray, each corner of the cover being folded inwardly over the top surface of the cover along a fold line parallel to but spaced outwardly from the beveled edge of the edge flange to form pull flaps, whereby the edges of the cover are rolled downwardly around and up under the edge flange on all sides of the tray to hold the cover in place.

2. The receptacle of claim 1, wherein the side walls of the tray are beveled in the four corners of the tray.

3. The receptacle of claim 2, wherein the beveled side walls are parallel to the beveled edge flange in the four corners of the tray.

4. The receptacle of claim 3, wherein the beveled side walls, edge flange and cover fold lines form an angle of approximately 135° with their adjacent wall or edge.

* * * * *